United States Patent [19]

Masuda

[11] Patent Number: 4,562,618

[45] Date of Patent: Jan. 7, 1986

[54] PAPER CLAMP

[75] Inventor: Michio Masuda, Osaka, Japan

[73] Assignee: N. K. Manufacturing Company Limited, Osaka, Japan

[21] Appl. No.: 580,944

[22] Filed: Feb. 16, 1984

[51] Int. Cl.[4] ..... B42F 1/00

[52] U.S. Cl. ..... 24/67.7; 24/511; 269/239; 269/254 R

[58] Field of Search ..... 24/67 R, 67.3, 67.5, 24/67.7, 67.11, 489, 499, 500, 495, 132 R, 508–511; 269/239, 254 R; 281/45

[56] References Cited

U.S. PATENT DOCUMENTS

| | | | |
|---|---|---|---|
| 1,128,593 | 2/1915 | Fort | 24/509 X |
| 2,227,106 | 12/1940 | Reenstierna | 24/511 X |
| 2,425,925 | 8/1947 | Davis | 24/67.3 X |
| 2,459,604 | 1/1949 | Verkuil | 24/508 X |
| 2,488,709 | 11/1949 | Colwell | 24/510 X |
| 2,815,557 | 12/1957 | Jorgensen | 24/489 X |
| 2,847,743 | 8/1958 | Voss | 24/67.3 X |
| 4,083,547 | 4/1978 | Garley | 269/239 X |

FOREIGN PATENT DOCUMENTS

| | | | |
|---|---|---|---|
| 28366 | 7/1931 | Australia | 24/508 |
| 321861 | 1/1903 | France | 24/489 |
| 151062 | 9/1920 | United Kingdom | 24/67.3 |

*Primary Examiner*—William E. Lyddane
*Assistant Examiner*—James R. Brittain
*Attorney, Agent, or Firm*—Collard, Roe & Galgano

[57] ABSTRACT

A paper clamp for holding documents together, usable on desks and permissible of one-hand operation, the paper clamp comprising:

a base plate; a pair of supports erected at opposite sides of the base plate; a lower plate pivotally supported by and between the pair of supports; an upper plate pivotally supported by and between the pair of supports, wherein the upper plate is pivotable in an opposite direction to that of the lower plate; the lower plate and the upper plate including toothed portions, which are in engagement with each other so as to enable the both plates to pivot in opposite directions; the upper plate terminating away from the terminating end of the lower plate; and a leaf spring provided between the lower plate and the base plate whereby the terminating end of the upper plate is placed into contact with the lower plate.

3 Claims, 7 Drawing Figures

PAPER CLAMP

BACKGROUND OF THE INVENTION

The present invention relates to a paper clamp usable on a desk for holding documents together, and more particularly, to a paper clamp for such use, the clamp being operated by one hand while the documents are held by the same hand.

Paper clamps are known and widely used to hold account slips and documents, and a known type of paper clamp has a pair of clamping flaps, which have mating ear members on each body for rotatively supporting a shaft. A coil spring is wound around the shaft, such that the clamping flaps undergo a force acting in a direction in which they are closed so as to hold documents therebetween.

However, this known structure requires the documents to be held by one hand, and the clamp to be operated by the other hand. Both hands are always full in handling the paper clamp on the desk.

OBJECTS AND SUMMARY OF THE INVENTION

The present invention is directed toward solving the problems pointed out above with respect to the known type of paper clamps, and has for its object to provide an improved paper clamp capable of operating with one hand while the same hand holds the documents to be clamped.

Another object of the present invention is to provide an improved paper clamp capable of securely holding even a thin slip regardless of its achieved simple construction.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to one advantageous aspect of the present invention, a paper clamp for holding documents together, which comprises:

a base plate;

a pair of supports erected at opposite sides of the base plate;

a lower plate pivotally supported by and between the pair of supports;

an upper plate pivotally supported by and between the pair of supports, wherein the upper plate is rotative in an opposite direction to that of the lower plate;

the lower plate and the upper plate including toothed portions, which are in engagement with each other so as to enable the both plates to rotate in opposite directions;

the upper plate terminating away from the terminating end of the lower plate; and a leaf spring provided between the lower plate and the base plate whereby the terminating end of the upper plate is placed into contact with the lower plate.

DETAILED DESCRIPTION OF THE INVENTION

Figure 1:
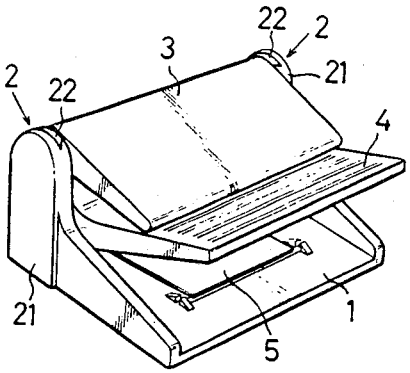
FIG. 1 is a perspective view of a paper clamp embodying the present invention.
Figure 2:
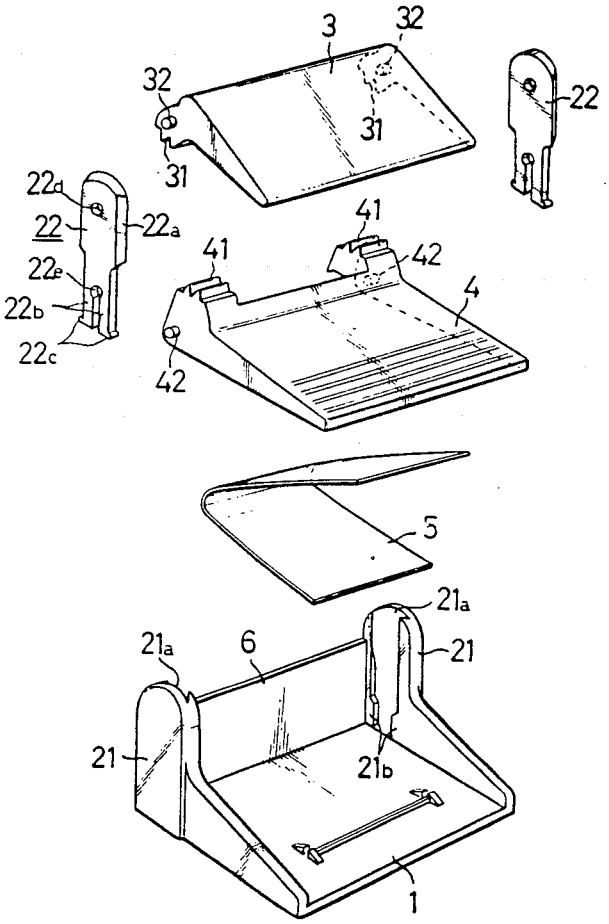
FIG. 2 is a perspective view showing the components in a disassembled state.
Figure 3:
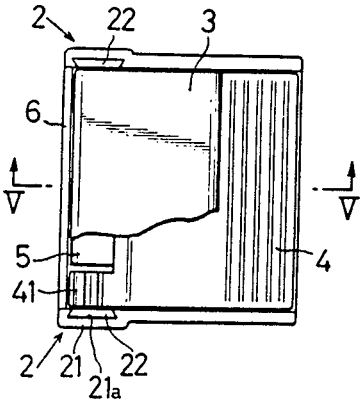
FIG. 3 is a plan view of the paper clamp, partially broken to show the inside structure normally covered by an upper plate.
Figure 4:
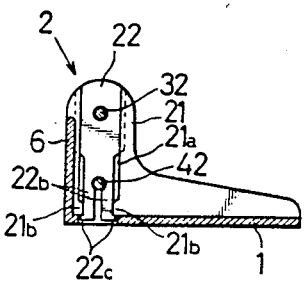
FIG. 4 is a cross-sectional side view showing a structural relationship between the base plate and the pair of supports erected on the base plate.

Referring to FIGS. 1 to 3, the paper clamp includes a base plate 1, which has a pair of supports 2 erected at opposite sides.

The support 2 includes a side member 21 erected on the base plate 1, and an inserted member 22 inserted in a slot 21*a* produced in the inner surface of the side member 21. The inserted member 22 has a configuration as shown in FIG. 2. The slot 21*a* has a dovetail section as best shown in FIG. 3, so as to prevent the inserted member 22 from slipping off the slot 21*a*. In addition, the inserted member 22 has a narrowed width shown at 21*b*, hereinafter referred to as the narrowed portion 21*b*, which is shown in FIG. 2.

The inserted member 22 has a sightly arched section so as to correspond to the dovetail section of the slot 21*a*. Each side edge 22*a* of has an inwardly slant face so as to dovetail with the slot 21*a*. The lower part of the inserted member 22 is branched into flaps 22*b*, each of which has a projection 22*c* adapted to enable the inserted member 22 to anchor in the slot 21*a*. That is, when the inserted member 22 is inserted in the slot 21*a* to the depth, the projections 22*c* are engaged with the bottoms of the narrowed portions 21*b*, thereby preventing the inserted member 22 from moving upward.

The inserted member 22 is provided with a lower aperture 22*e* and an upper aperture 22*d*, which are used to pivotally support a lower plate 4 and an upper plate 3, respectively, which are designed to function as clamping members. The lower plate 4 is provided with toothed portions 41 adjacent to the pivotal points at which pins 42 thereof are inserted in the lower apertures 22*e*. Likewise, the upper plate 3 is provided with toothed portions 31, which are engageable with the toothed portions 41 of the lower plate 4 such that the upper plate 3 and the lower plate 4 are rotated in clamping directions. The upper plate 3 is designed to terminate away from the terminating end of the lower plate 4 as shown in FIG. 1, thereby enabling the upper plate 3 to come into tight contact with the lower plate 4, which will be hereinafter described in detail.

The base plate 1, the supports 2, and the two plates 3, 4 can be made of plastics because of its lightweight. In the illustrated embodiment the base plate 1 and the pair of supports 2 are made in one piece.

Figure 5:
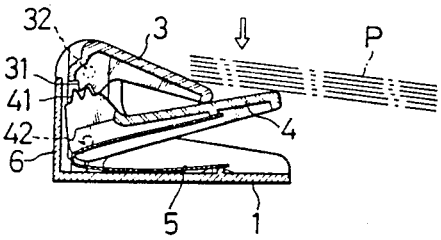
FIG. 5 is a sectional view taken along the line V—V in FIG. 3.

The reference numeral 5 designates a leaf spring, which is bent so as to have a V-shaped cross-section. The leaf spring 5 is provided between the lower plate 4 and the base plate 1, whereby the lower plate 4 is constantly subjected to upward urge toward the upper plate 3. The rotational movement of the lower plate 4 in a counter-clockwise direction causes the upper plate 3 to rotate in a clockwise direction, thereby enabling both the plates 3 and 4 to come into tight contact with each other as shown in FIG. 5. The reference numeral 6 designates a rear wall, which is prefereably made integrally with the base plate 1.

When the paper clamp is assembled, the upper and the lower plate 3 and 4 are engaged in their toothed portions 31 and 41, and their pins 32 and 42 are inserted in the upper and the lower apertures 22*d* and 22*e*, respectively. Then, the inserted members 22 are inserted in the slots 21*a* until the projections 22*c* thereof are engaged with the bottoms of the narrowed portions 21*b*. Finally, the leaf spring 5 is placed between the the base plate 1 and the lower plate 4. In this way the paper clamp can be readily assembled.

Figure 6:
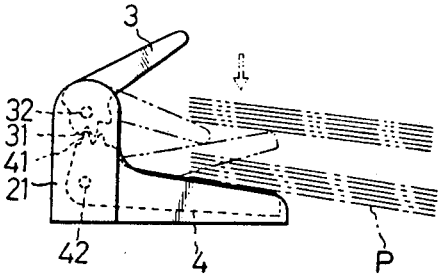
FIG. 6 is a side view exemplifying the action of the upper and the lower plates.
Figure 7:
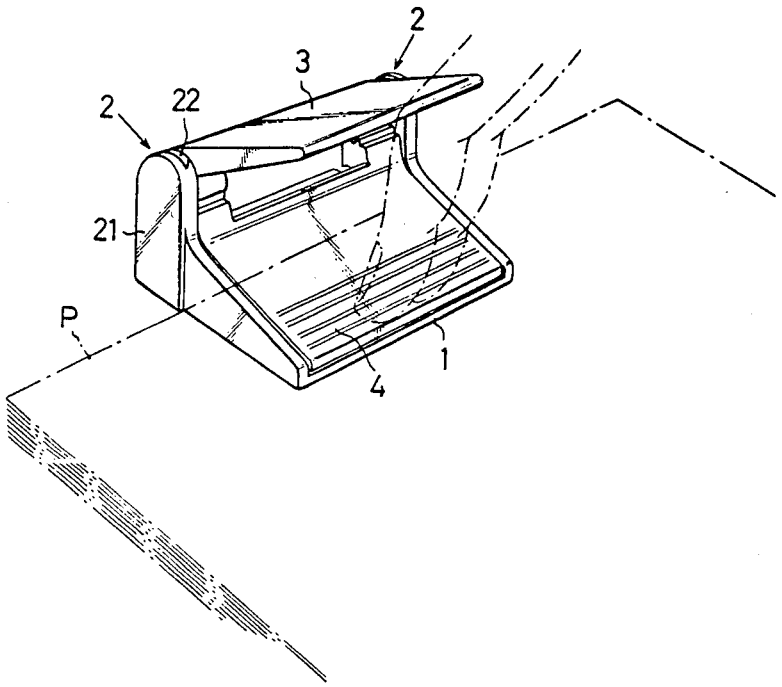
FIG. 7 is a perspective view exemplifying the paper clamp in operation by an operator's finger.

In use, the lower plate 4 is pressed downward by a finger in the direction indicated by the arrow in FIG. 5. As a result, the lower plate 4 is rotated in a clockwise direction, whereas the upper plate 3 is rotated in a counter-clockwise direction, thereby allowing both the plates 3 and 4 to be away from each other as shown in FIG. 6. As shown in FIG. 6, the document P is placed on the edge portion of the upper plate 3, and the lower plate 4 is further pressed from on the surface of the document P. The document P slips off the edge portion of the upper plate 3, and slides down onto the lower plate 4. At this stage the finger is withdrawn from the lower plate 4, thereby allowing the lower plate 4 to return to its original state under the action of the leaf spring 5. The upper plate 3 also returns to its original state, at which it again comes into tight contact with the lower plate 4 with the documents P being clamped between the upper and the lower plate 3 and 4.

As evident from the foregoing, the paper clamp can be handled by one hand alone. In addition, the structure is simple and lightweight. The document is securely clamped.

What is claimed is:

1. A paper clamp for holding documents together, the paper clamp comprising:

a base plate;

a pair of supports erected at opposite sides of the base plate, each support having a slot in its inner surface and a fixed member removably inserted in said slot;

a lower plate and an upper plate pivotally supported by said fixed members of said supports, said upper plate being pivotable in an opposite direction to that of the lower plate, said lower and upper plates each including a toothed portion, which are in engagement with each other so as to enable both plates to pivot in opposite directions, and said upper plate having a clamping end which terminates in an offset manner relative to an end of said lower plate; and a leaf spring provided between said lower plate and said base plate for biasing said lower plate into contact with said upper plate.

2. A paper clamp as defined in claim 1, wherein the toothed portions of the upper and the lower plate are located adjacent to the pivotal points between the respective plates.

3. A paper clamp as defined in claim 1, wherein the leaf spring is bent so as to have a V-shaped cross-section.

* * * * *